United States Patent [19]

Bard et al.

[11] 4,122,641

[45] Oct. 31, 1978

[54] WALL STRUCTURE

[75] Inventors: John A. Bard, Dearborn; Francis J. Morrison, Grosse Ile, both of Mich.

[73] Assignee: Walcon Corporation, Ecorse, Mich.

[21] Appl. No.: 819,799

[22] Filed: Jul. 28, 1977

[51] Int. Cl.[2] ..... E04C 1/10; E04B 1/90

[52] U.S. Cl. ..... 52/403; 52/595

[58] Field of Search ..... 52/589–595, 52/403, 618

[56] References Cited

U.S. PATENT DOCUMENTS

| | | | |
|---|---|---|---|
| 3,514,915 | 6/1970 | Johnson | 52/593 X |
| 3,667,180 | 6/1972 | Tischuk | 52/595 |
| 3,797,190 | 3/1974 | Widdowson | 52/403 |
| 4,044,511 | 8/1977 | Lingle | 52/593 |

*Primary Examiner*—J. Karl Bell

*Attorney, Agent, or Firm*—Robert G. Mentag

[57] ABSTRACT

A prefabricated panel comprising a pair of panel forming members wherein each of the panel forming members is made up of a continuous sheet of material of uniform thickness. The panel forming members are mechanically secured together by a plurality of spaced apart sub-girt members. The panel forming members may be used with or without an insulation means. The panel forming members are laterally offset from each other, and they may have various profiles or identical profiles.

12 Claims, 14 Drawing Figures

WALL STRUCTURE

BACKGROUND OF THE INVENTION

1. Field of the Invention

This invention relates to the structural panel art, and more particularly to a prefabricated structural panel.

2. Description of the Prior Art

It is well known in the structural panel art to provide prefabricated structural panels, and especially panels which have foamed in situ insulation mounted therein and chemically bonded to the inside surface of the panel members. For example, U.S. Pat. Nos. 3,386,218 and 3,535,844 show prefabricated structural panels having foamed in situ insulation. However, a disadvantage of the prior art panels is that they are initially high in cost and difficult to assemble in the field. Some prior art panels have poor thermal insulation values because of through metal. Furthermore, it is costly and time consuming to make repairs on the prior art prefabricated panels. Also, the prior art prefabricated panels have a disadvantage that the foamed in situ urethane insulation has been found to be combustible and flammable, and accordingly, a safety problem is present when such panels are used. Furthermore, the chemical bond holding the bonded insulation in place is not permanent and deteriorates through time and use.

SUMMARY OF THE INVENTION

This invention relates to structural panels and, in particular, to a structural panel which may be prefabricated and insulated, and erected on the job site.

It is an object of the present invention to provide a novel and improved prefabricated structural panel which comprises two shaped metal panel members that are disposed facing each other in a lateral offset relationship and wherein the two panel members are secured together by a plurality of sub-girt fastening members that are disposed in spaced apart positions on axes approximately perpendicular to the longitudinal axis of the panel members. Each of the sub-girt fastening members is mechanically attached to the panel members, and they are provided with a locating and retaining flange means for maintaining the panel members in their lateral offset relationship. Each of the panel members is adapted to have mounted therein a suitable insulation means as, for example, fiberglass insulation means which may be slidably mounted therein. The panel members are provided along each side thereof with a suitable tubular seal means, or caulking.

The structural panel of the present invention has a low U-value and a low thermal transmission value, and it can be economically and easily erected on the work site. The construction of the structural panel of the present invention is such that a load can be transferred from the outside panel member to the inside panel member through the sub-girt fastening means so as to provide a structural panel wherein the total strength of the structural panel is greater than the sum of two panel members per se. The structural panel can be easily repaired in the field, and it may be provided with acoustic openings through the inner panel member for adsorption of sound. The structural panel overcomes the flammable and combustible situation present in the prior art structural panels wherein the insulation is foamed in situ and bonded in place.

Other features and advantages of this invention will be apparent from the following detailed description, appended claims, and the accompanying drawings.

DESCRIPTION OF THE PREFERRED EMBODIMENTS

Figure 1:
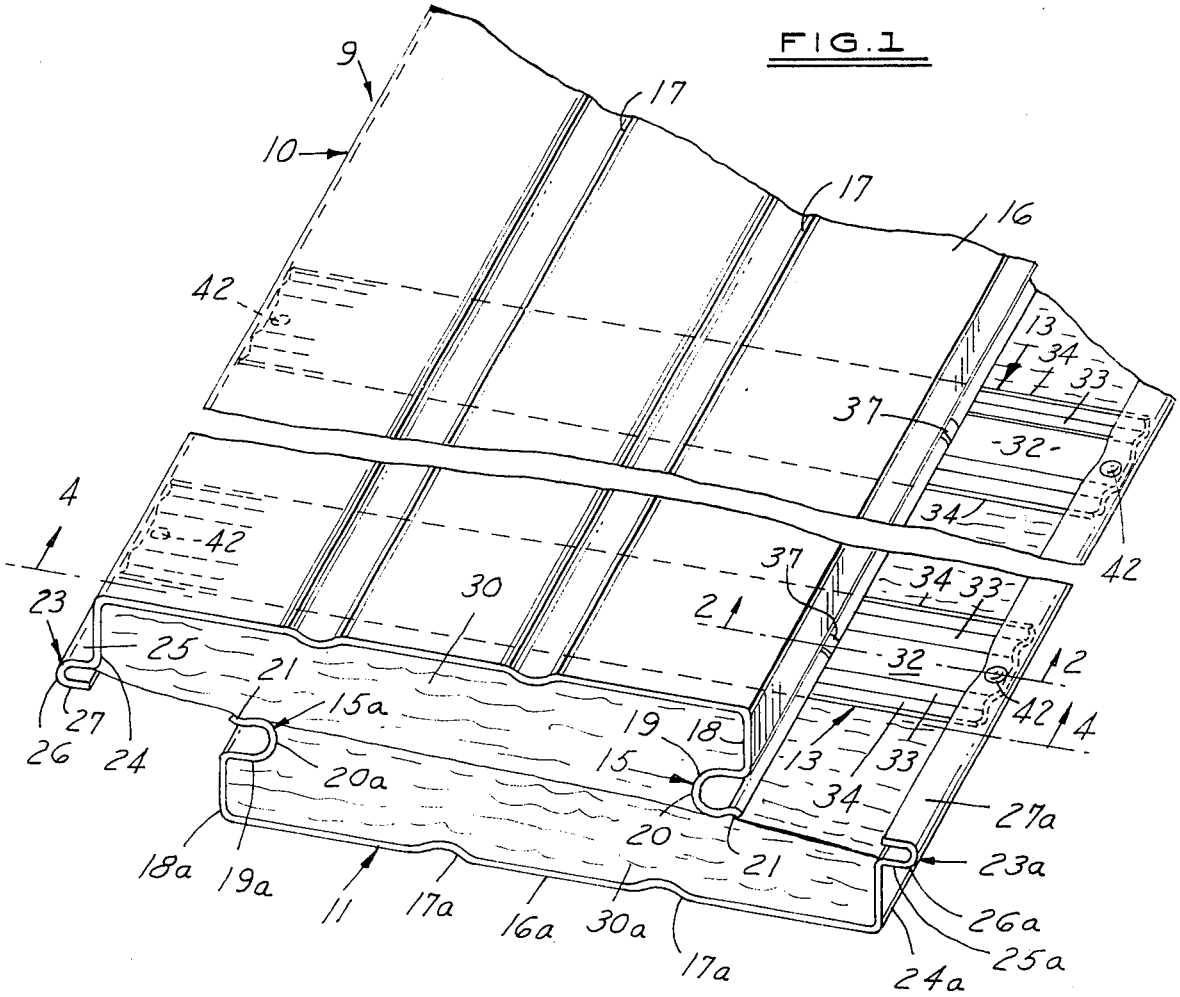
FIG. 1 is a fragmentary, broken isometric view of a first embodiment structural panel made in accordance with the principles of the present invention.

Referring now to the drawings, and in particular to FIG. 1, the numeral 9 generally designates a first embodiment structural panel made in accordance with the principles of the present invention, and which includes a pair of panel members generally designated by the numerals 10 and 11. The numeral 13 generally designates a sub-girt fastening member, of which a plurality are employed for securing the panel members 10 and 11 together. The two panel members 10 and 11 are identical in profile, but it will be understood that they may have different profiles, and the outer surfaces may be finished as desired. For example, if the panel member 10 comprises the interior face of the structural panel 9, it may be provided with a surface treatment and finish suitable for interior purposes. The panel member 11 would then comprise the exterior face of the structural panel 9 and would be provided with a suitable exterior surface, texture and finish.

Figures 2, 3, 4:
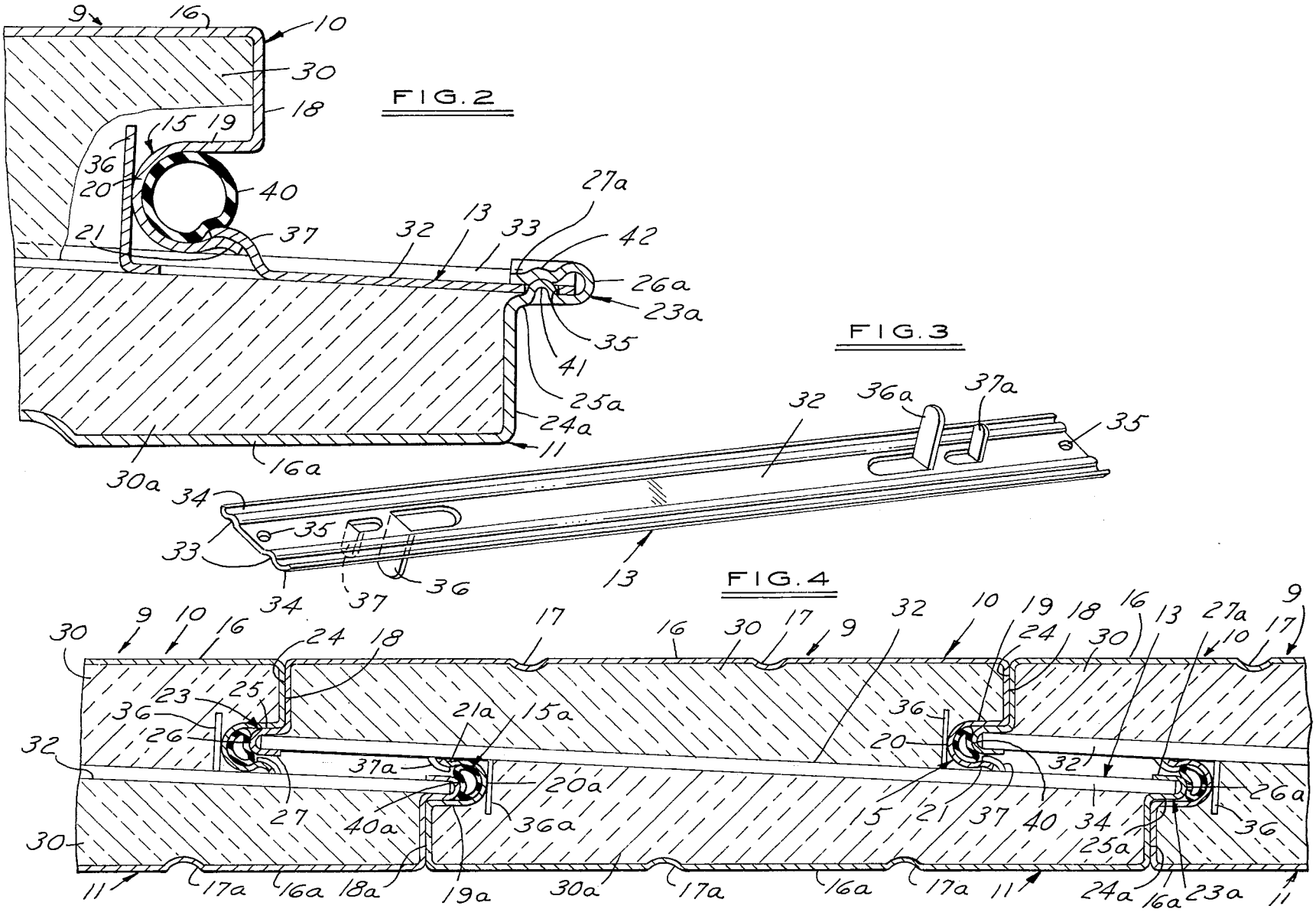
FIG. 2 is a fragmentary, enlarged, elevation section view of the structure illustrated in FIG. 1, taken along the line 2—2 thereof, and looking in the direction of the arrows.
FIG. 3 is a perspective view of a sub-girt fastening member employed in fastening the panel inside and outside sheets or skins together.
FIG. 4 is an elevation section view of the structural panel illustrated in FIG. 1, taken along the line 4—4 thereof, and looking in the direction of the arrows.

As shown in FIGS. 1 and 4, the panel member 10 is formed from a single sheet or skin and includes an elongated main wall portion 16 which is flat and planar and substantially rectangular in plan view. The panel wall portion 16 is provided with a plurality of spaced apart, longitudinally extended grooves 17 for appearance and strength stiffening purposes. The panel member 10 includes along one side thereof an integral side wall portion 18 which extends inwardly at right angles to the plane of the main wall portion 16, and which terminates in an integral, substantially U-shaped mechanical joint member, generally indicated by the numeral 15. The mechanical joint member 15 includes a straight leg portion 19 which has one end integral with the inner end of the side wall portion 18, and the other end integral with one end of a U-shaped bight portion 20. The mechanical joint member 15 further includes a second integral arcuate leg portion 21 which has one end integral with the other end of the U-shaped bight portion 20 and the other end extended to a point substantially parallel with the plane of the side wall portion 18. The arcuate leg portion 21 has an arcuate central portion which is shaped convex inwardly toward the opposite straight leg 19.

As shown in FIGS. 1 and 4, the panel member 10 includes along the other side thereof an integral side wall portion 24 which extends inwardly at right angles to the plane of the main wall portion 16, and which terminates at its inner end in an integral U-shaped mechanical joint member, generally indicated by the numeral 23. The U-shaped joint member 23 includes a pair of straight, parallel side walls 25 and 27, which are integral with a U-shaped bight portion 26. The inner end of the joint side wall 25 is integral with the inner end of the side wall portion 24. The joint bight portion 26 and the joint side wall 27 are offset or extended inwardly, beyond the inner edge of the joint member 15 formed on the other end of the panel member 10. As shown in FIGS. 1 and 4, the joint members 15 and 23 are both disposed with their open ends facing in the same direction, that is, to the right, as viewed in FIGS. 1 and 4. The joint member 15 extends laterally inward of the side wall portion 18, while the joint member 23 extends laterally outward of the side wall portion 24. As shown in FIGS. 1, 2 and 4, the panel member 10 is provided with a suitable insulation 30, such as a fiberglass insulation, which may be mounted in the panel member 10 by sliding the same endwise after the panel member 10 has been formed. The insulation 30 may or may not be adhered to the inside surface of the panel member 10, as desired. Preferably, however, the insulation 30 is merely slid in place within the panel member 10.

The structural panel 9 of the present invention includes a second panel member 11 which is illustrated in this embodiment to be identical to the panel member 10. The parts of the panel member 11 which are the same as the parts of the panel member 10 are marked with the same reference numerals, followed by the small letter "*a*". As shown in FIG. 4, the structural panel 9 is formed by joining the panel members 10 and 11 in an offset and reverse manner with their inner sloping faces abutting each other. As viewed in FIG. 4, the panel member 11 is offset to the right relative to the panel member 10.

The sub-girt fastening member 13 is shown in a perspective view in FIG. 3, and it is adapted for mechanically joining the panel members 10 and 11 securely together to form the structural panel 9. As shown in FIG. 3, the sub-girt fastening member 13 comprises an elongated member which has a longitudinally extended flat, central body portion 32 which is provided on each end with a hole 35. Integrally formed along each longitudinal side edge of the body 32 is a convex, longitudinally extended rib 33. Integrally formed along the outer longitudinal edge of each of the ribs 33 is a concave rib 34. Adjacent one of the ends of the sub-girt body portion 32 is provided a downwardly extended fastening tang or prong 37, which is struck from the sub-girt body portion 32, and which extends therefrom at right angles in the free state before assembly of the same in the structural panel 9. A flange 36 is also struck from the sub-girt body portion 32 in a position spaced inwardly from the tang 37 and parallel thereto, as shown in FIG. 3. A second tang 37*a* and flange 36*a* are also formed at the other end of the sub-girt body 32, but they extend upwardly in the opposite direction to the tang 37 and the flange 36.

The prefabricated structural panel 9 may be made to any desired width and length. For example, the structural panel 9 may be 2 feet, 3 feet or 4 feet wide, and so forth. The structural panel 9 has an advantage in that it can be prefabricated in the shop for erection in the field. The panel 9 may also be made to any desired length, as for example 7 feet, 8 feet, 9 feet, 10 feet and so forth. It will be understood that the main wall portion 16 of the inner panel member may be provided with holes or perforations therethrough for sound absorption purposes as desired. It will also be understood that the main body portions 16 and 16*a* may have indentations or various shapes, other than the grooves 17, for functional or appearance purposes.

The prefabricated structural panel 9 is assembled, as shown in FIGS. 1, 2 and 4, with one of the panel members, as the panel 11, being offset about 2 or 3 inches laterally relative to the other panel member 10. The sub-girts 13 are disposed at any desired distance apart from each other, as for example, 2 feet, 3 feet, 4 feet, and so forth. The sub-girt 13 of FIG. 3 is shown in a reversed and inverted position in the assembly of FIG. 4, for providing a mechanical connection means between the panel members 10 and 11.

As shown in FIG. 4, a sub-girt 13 has one end slid into the adjacent U-shaped joint member or rib 23*a*, and the tang 37 is bent or folded inwardly over the leg 21 of the mechanical joint member or rib 15 to securely lock the adjacent ends of the panel members 10 and 11 into position. The same locking action is also provided at the other end of the sub-girt 13 where the other end of the sub-girt 13 is inserted into the U-shaped joint member 23 and the tang 37*a* is bent over the leg portion 21 of the joint member or rib 15*a*. It will be seen that the flanges 36 and 36*a* abut the adjacent U-shaped joint members or ribs 15 and 15*a*, respectively. The sub-girts 13 are also mechanically attached to the panel members 10 and 11 by crimping. As shown in FIG. 2, the parallel side wall 25*a* of the U-shaped joint member 23*a* is crimped upwardly through the adjacent hole 35 in a sub-girt body 32. The joint side wall 27*a* is also displaced upwardly. The other end of each sub-girt 32 is also similarly attached to the U-shaped joint member 23. Vinyl gaskets 40 or suitable caulking are mounted in the U-shaped joints 15 and 15*a*.

It will be seen that the structural panel 9 does not depend on any chemical bond to provide strength and stiffness, as is provided in the prior art panels wherein urethane is foamed in situ in a structural panel. The assembled structural panel 9 is consistent and permanent, and variations due to raw materials, factory conditions or operator tolerances, or those encountered on the job site, due to aging, extremes in temperature, humidity or chemical content of the air, will not affect the life of the structural panel 9. The lengths to which the prefabricated structural panel 9 may be made are limited only by shipping and handling conditions. As stated hereinbefore, flat, concave or high-lighted panel configurations, may be provided in the body portion 16 of each of the panel members 10 and 11, as desired. The prefabricated structural panels 9 are easily erected on supporting frame structures on the jobe site, and no clips, bolts or other exposed fasteners are necessary. It will be seen that the structural panel 9 of the present invention is of a construction wherein if either one of the surface elements of the panel members 10 and 11 is damaged during erection or thereafter, that either one of the panel members 10 and 11 may be quickly and easily removed and replaced, without injury or destroying the entire panel. The vinyl tubular gaskets 40, or a suitable caulking, provide a sealing effect, as well as an insulating effect. The structural panel 9 of the present invention provides a panel with a finished inside and outside metal surface, thermal and/or acoustic insulation, vapor barrier, seal, and an exterior finished metal face in a single, self-contained, modular unit. The prefabricated panel of the present invention may be easily delivered, stored and erected with a resultant reduction in field costs as compared to panels which must be assembled in the field.

Figure 5:
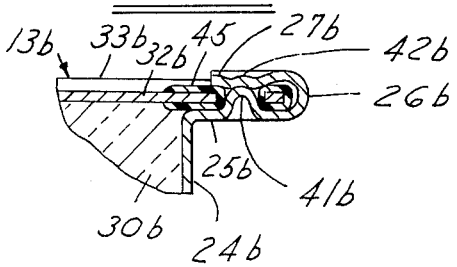
FIG. 5 is a fragmentary, elevation section view of the offset end of a modified structural panel, showing the use of plastic insulation at the mechanical joint between the sub-girt and the edge of one of the panel joints.

FIG. 5 shows a fragmentary, elevation section view of the offset end of a modified structural panel, wherein a U-shaped elongated plastic thermal insulation 45 is employed in the mechanical joint, between the end of the sub-joint and the edge of the panel joints. The plastic thermal insulation is indicated by the numeral 45. The parts of the modified panel of FIG. 5 which are the same as the first described panel of FIGS. 1 through 4 have been marked with the same reference numerals followed by the small letter "*b*".

FIGS. 6 through 10 illustrate a second prefabricated structural panel, generally indicated by the numeral 50, and which includes a pair of panel members generally designated by the numerals 51 and 52. The numeral 53 generally designates a sub-girt fastening member which is employed for securing the panel members 51 and 52 together. A plurality of sub-girt fastening members 53 are employed in the same manner as the sub-girts 13 of the first embodiment. The two panel members 51 and 52 are identical in profile, and the outer surfaces may be finished, as desired, as explained hereinbefore for the first embodiment of FIGS. 1 through 4.

Figure 6:
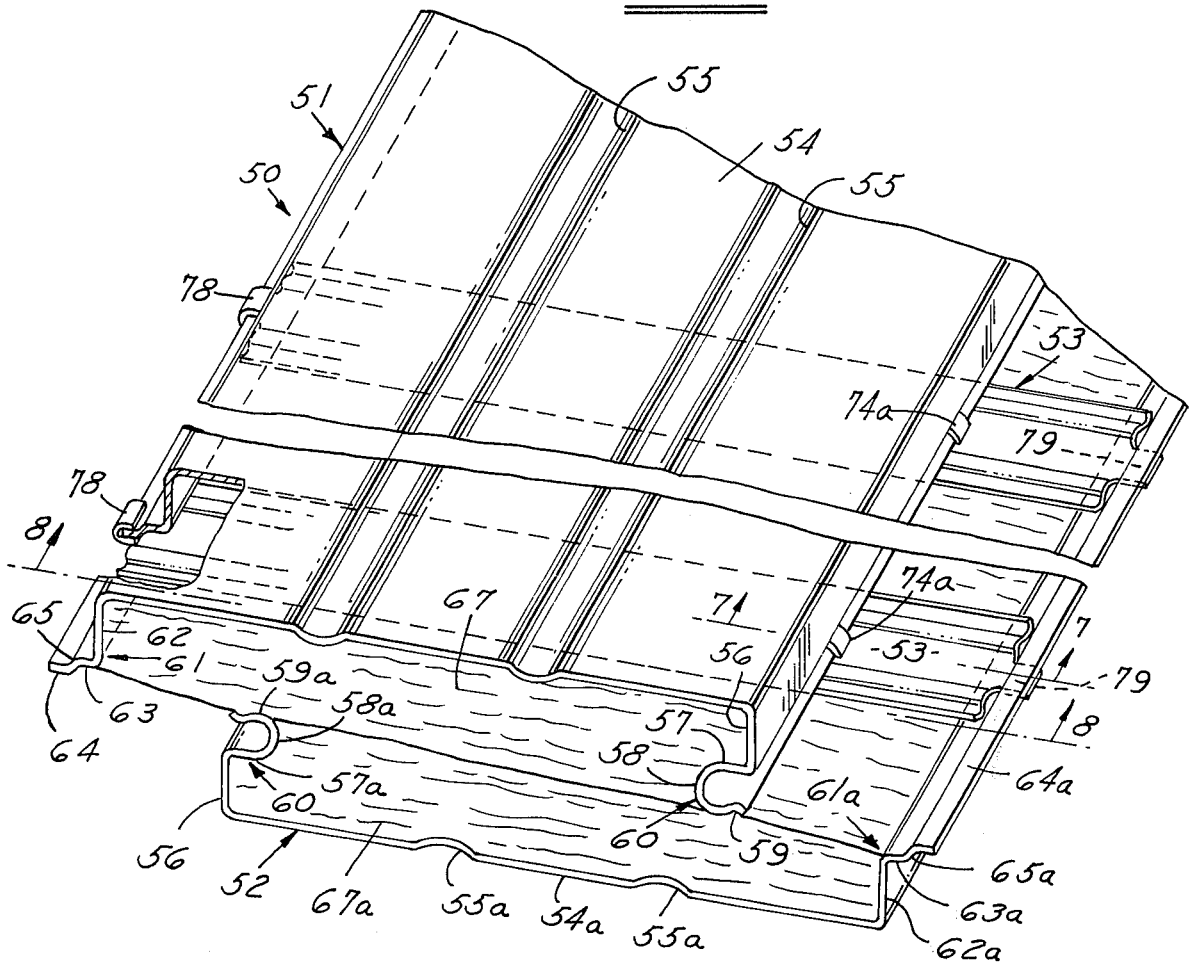
FIG. 6 is a fragmentary, broken, isometric view of a second embodiment structural panel made in accordance with the principles of the present invention.
Figure 10:
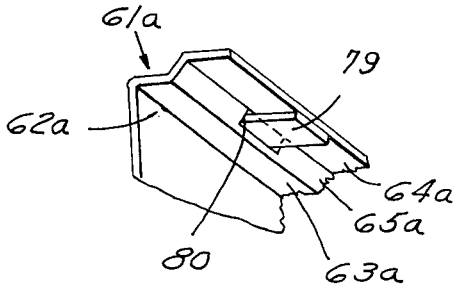
FIG. 10 is a fragmentary, perspective view of the structure illustrated in FIG. 7, and taken in the direction of the arrow marked 10.
Figures 7, 8, 9:
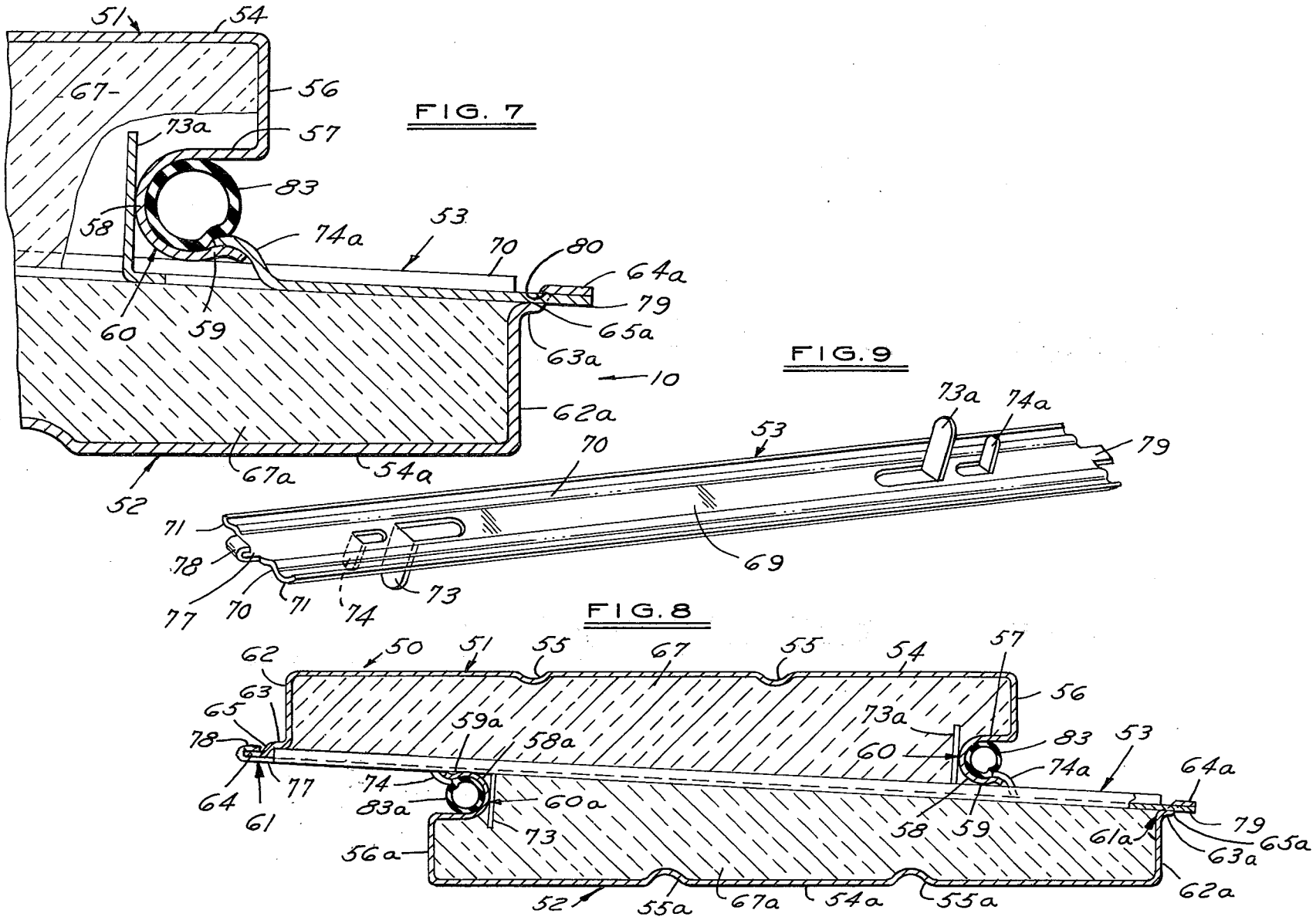
FIG. 7 is a fragmentary, enlarged, elevation section view of the structure illustrated in FIG. 6, taken along the line 7—7 thereof, and looking in the direction of the arrows.
FIG. 8 is an elevation section view of the structural panel illustrated in FIG. 6, taken along the line 8—8, and looking in the direction of the arrows.
FIG. 9 is a broken, perspective view of a sub-girt fastening member employed with the structural panel of FIGS. 7 and 8.

As shown in FIGS. 6 and 7, the panel member 51 is formed from a single sheet or skin that includes an elongated main wall portion 54 which is flat and planar, and substantially rectangular in plan view. The panel wall portion 54 is provided with a plurality of spaced apart, longitudinally extended grooves 55, for appearance and strength stiffening purposes. The panel member 54 includes along one side thereof an integral side wall portion 56 which extends inwardly at right angles to the plane of the main wall portion 54 and which terminates in an integral, substantially U-shaped mechanical joint, generally indicated by the numeral 60. The mechanical joint member 60 includes a straight leg portion 57 which has one end integral with the inner end of the side wall portion 56, and the other end integral with one end of a U-shaped bight portion 58. The mechanical joint member 60 further includes a second integral arcuate leg portion 59 which has one end integral with the other end of the U-shaped bight portion 58, and the other end extended to a point substantially parallel with the plane of the side wall portion 56. The arcuate leg portion 59 has an arcuate central portion which is shaped convex inwardly, toward the opposite straight leg 57.

As shown in FIGS. 6 and 8, the panel member 51 also includes along the other side thereof an integral side wall portion 62 which extends inwardly at right angles to the plane of the main wall portion 54, and which terminates at its inner end in an integral U-shaped mechanical joint member, generally indicated by the numeral 61. The joint member 61 includes a first elongated flange 63 which extends for the length of the panel member 54 and is integral at its inner end with the inner end of the side wall portion 62. The joint member 61 further includes a second elongated flange 64 which is parallel to the flange 63, and offset inwardly, and connected thereto by an integral angled flange 65. As shown in FIGS. 6, 7 and 8, the panel member 51 is provided with a suitable insulation 67, of the same type as described hereinbefore for the first embodiment of FIGS. 1 through 4.

The structural panel 50 includes a second panel member 52 which is formed identical to the panel member 51. The parts of the panel member 52 which are the same as the parts of the panel member 51 are marked with the same reference numerals followed by the small letter "*a*". As shown in FIGS. 6 and 8, the structural panel 50 is formed by joining the panel members 51 and 52 in an offset manner, with their inner faces abutting each other in the same manner as the first described embodiment of FIGS. 1 through 4. As viewed in FIG. 8, the panel member 52 is offset to the right relative to the panel member 51.

A metal sub-girt fastening member 53, which is employed in the second embodiment of FIGS. 6 through 10, is shown in a perspective view in FIG. 9, and it is adapted for mechanically joining the panel members 51 and 52 securely together to form the prefabricated structural panel 50.

As shown in FIG. 9, the sub-girt fastening member 53 comprises an elongated member which has a longitudinally extended flat, central body portion 69. Integrally formed along each longitudinal side edge of the body 69 is a convex, longitudinally extended rib 70. Integrally formed along the outer longitudinal edge of each of the ribs 70 is a concave rib 71. Adjacent one of the ends of the sub-girt body portion 69 is provided a downwardly extended fastening tang or prong 74, which is struck from the sub-girt body portion 69, and which extends therefrom at right angles in the free state before assembly of the same in the structural panel 50. A flange 73 is also struck from the sub-girt body portion 69 is a position spaced inwardly from the tang 74 and parallel thereto, as shown in FIG. 9. A second tang 74*a* and flange 73*a* are also formed at the other end of the sub-girt body 69, but they extend upwardly in the opposite direction to the tang 74 and the flange 73. Integrally formed at one end of the sub-girt body 69 is an outwardly extended, centrally located flat tongue 79. Integrally formed at the opposite end of the sub-girt body 69 in a position in aligment with the tongue 79 is a flat arm 77, on the outer end of which is integrally formed a U-shaped hook 78.

The prefabricated panel 50 illustrated in FIGS. 6 through 10 may be made to any desired width and length, as described hereinbefore for the first embodiment of FIGS. 1 through 4. The prefabricated structural panel 50 is assembled, as shown in FIGS. 6, 7 and 8, with one of the panel members, as the panel member 52, being offset laterally about 2 or 3 inches relative to the other panel member 51. The sub-girts 53 are disposed at any desired distance apart from each other, as for example, 2 feet, 3 feet, 4 feet and so forth. As shown in FIGS. 6, 7, 8 and 10, the tongue 79 is slid through a slot 80 formed through the joint flange **65*a* in the panel member 52, and the tang 74*a* is bent or folded inwardly over the leg 59 of the mechanical joint member or rib 60 so as to securely lock together the adjacent ends of the panel members 10 and 11. A similar locking action is also provided at the other end of the sub-girt 53. As shown in FIG. 8, the joint flange 64 on the other end of the panel member 51 is seated in the hook 78 of the sub-girt member 53, and the tang 74 is bent or folded inwardly over the adjacent leg 59*a* of the mechanical joint or rib 60*a*. A vinyl tubular gasket 83, or a suitable caulking are mounted in the U-shaped joints 60 and 60*a*. It will thus be seen that the embodiment of FIGS. 6 through 10 is comprised of two panel members which may be quickly and easily mechanically secured together to form a prefabricated structural panel. The panel embodiment of FIGS. 6 through 10 offers the same advantages and features described hereinbefore for the first embodiment of FIGS. 1 through 4**.

Figure 11:
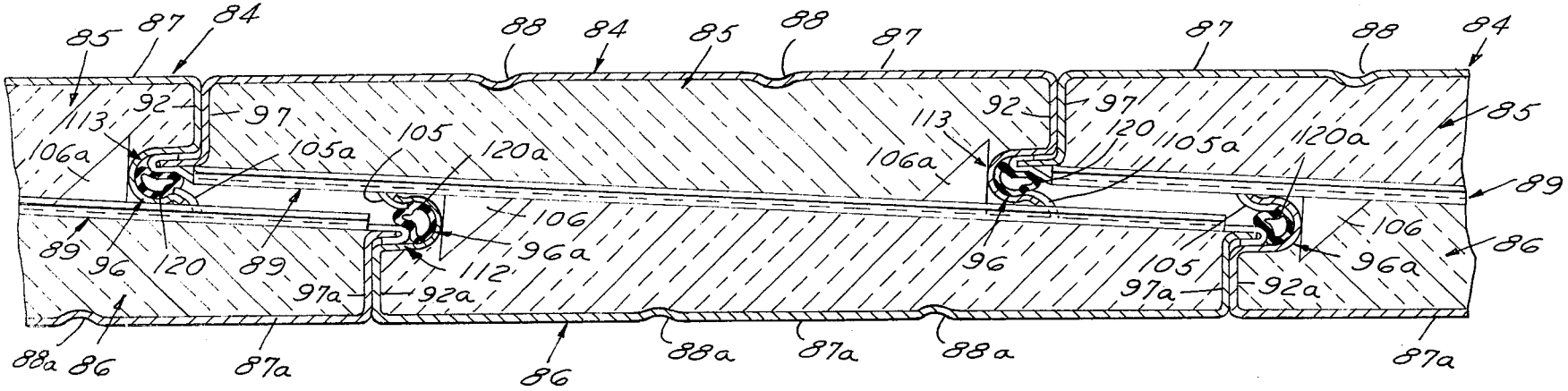
FIG. 11 is a section view of a panel wall assembly illustrating a third embodiment structural panel made in accordance with the principles of the present invention.
Figure 12:
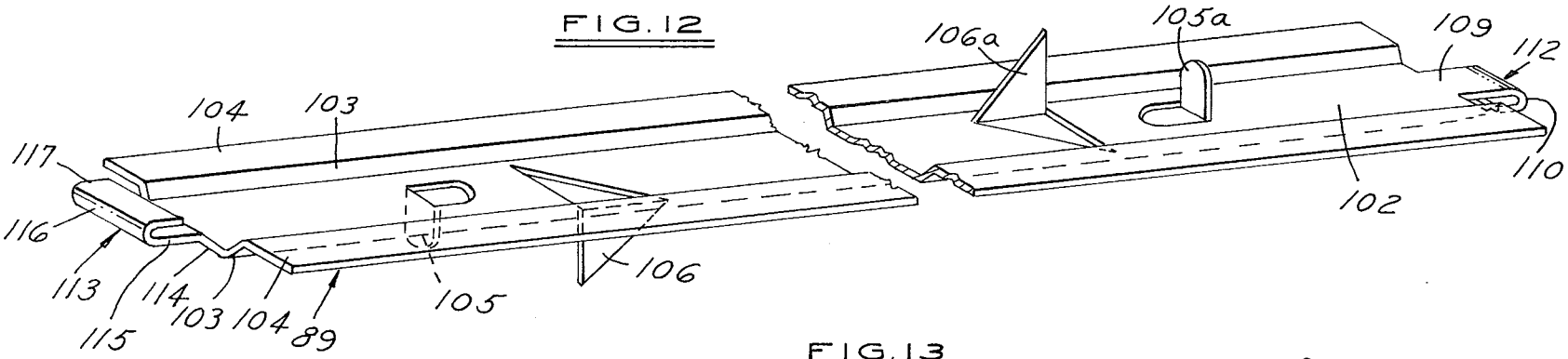
FIG. 12 is a perspective view of a sub-girt fastening member employed with the structural panel assembly illustrated in FIG. 11.
Figure 13:
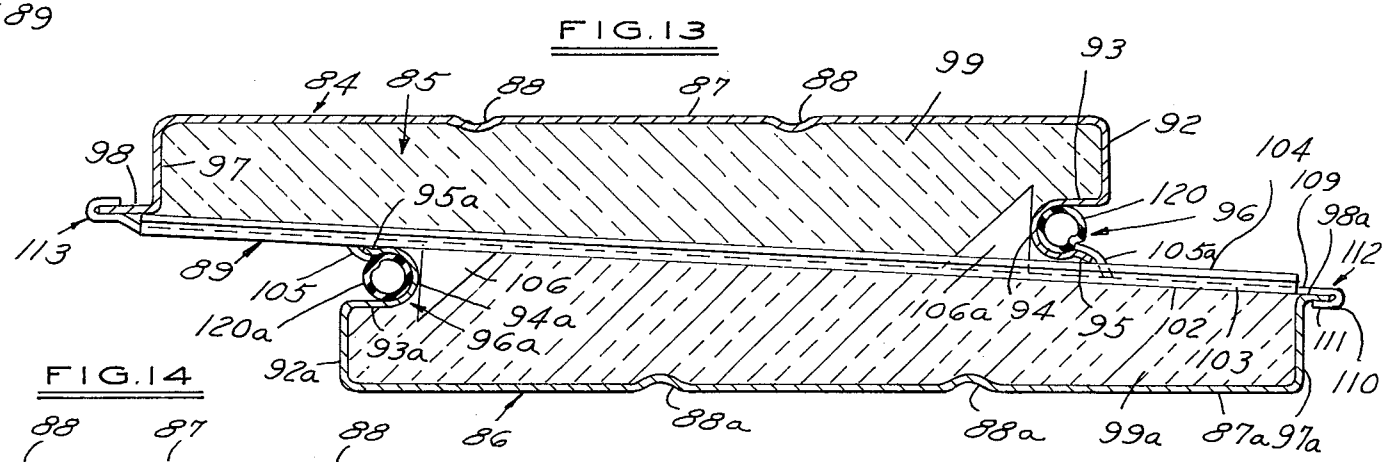
FIG. 13 is a sectional view of a single panel employed in the panel wall assembly of FIG. 11.

FIGS. 11 through 13 illustrate a third prefabricated structural panel, generally indicated by the numeral 84, and which includes a pair of panel members generally designated by the numerals 85 and 86. The numeral 89 generally designates a sub-girt fastening member which is employed for securing the panel members 85 and 86 together. A plurality of sub-girt members 89 are employed in the same manner as the sub-girts 13 and 53 of the aforedescribed first and second embodiments. In the embodiment of FIGS. 11, 12 and 13, the two panel members 85 and 86 are identical in profile, but it will be understood that each of the panel members could have different profiles, as described hereinafter. The outer surfaces of the panels 85 and 86 may be finished in the same manner as explained hereinbefore for the first embodiment of FIGS. 1 through 4, and the second embodiment of FIGS. 6 through 10.

As shown in FIGS. 11 and 12, the panel member 84 is formed from a single sheet or skin that includes an elongated main wall portion 87, which is flat and planar, and substantially rectangular in plan form. The panel wall 87 is provided with a plurality of spaced apart, longitudinally extended grooves 88, for appearance and strength stiffening purposes. The panel member 85 includes along one side thereof an integral side wall portion 92 which extends inwardly at right angles to the plane of the main wall portion 87, and which terminates in an integral, substantially U-shaped mechanical joint, generally indicated by the numeral 96. The mechanical joint member 96 includes a straight leg portion 93 which has one end integral with the inner end of the side wall portion 92, and the other end integral with one end of a U-shaped bight portion 94. The mechanical joint member 96 further includes a second integral arcuate leg portion 95, which has one end integral with the other end of the U-shaped bight portion 94, and the other end extended to point substantially parallel with the plane of the side wall portion 92. The arcuate leg portion 95 has an arcuate central portion which is shaped convex inwardly, toward the opposite straight leg 93.

As shown in FIGS. 11 and 13, the panel member 85 also includes along the other side thereof an integral side wall portion 97 which extends inwardly at right angles to the plane of the main wall portion 87, and which terminates at its inner end in an integral outwardly extended flange 98. The flange 98 is formed perpendicular to the side wall portion 97. It will be seen that the overall length of the first mentioned sidewall 92 and the U-shaped mechanical joint member 96 extends inwardly a distance greater than the length of the other side wall 97, in the same manner as the previously disclosed first and second embodiments. The panel member 85 is illustrated as being provided with a suitable insulation 99, but it will be understood that the structural panel of FIGS. 11 through 13 may be made without any insulation, if desired.

In the illustrated embodiment of FIGS. 11 through 13, the second panel member 86 is formed identical in profile to the first described panel member. The parts of the panel member 86, which are the same as the parts of the panel member 85, are marked with the same reference numerals followed by the small letter "*a*". As shown in FIGS. 11 and 13, the structural panel 84 is formed by joining the panel members 85 and 86 in an offset manner, in which their inner faces abut each other in the same manner as the first and second described embodiments. As viewed in FIGS. 11 and 13, the panel member 86 in each of the structural panels is offset to the right relative to its mating panel member 85.

A sub-girt fastening member 89 is employed in the third embodiment of FIGS. 11 through 13, and it is shown in a perspective view in FIG. 12. The sub-girt fastening member 89 is adapted for mechanically joining the panel members 85 and 86 securely together to form the prefabricated structural panel 84. It will be understood that the sub-girt fastening member 89 may be made of any suitable material, as a suitable metal material.

As shown in FIG. 12, the sub-girt fastening member 89 comprises an elongated member which has a longitudinally extended flat, central body portion 102. Integrally formed along each longitudinal side edge of the central body portion 102 is an upwardly and outwardly angled flange 103. Integrally formed along the outer longitudinal edge of each of the flanges 103 is a flat flange 104 which is disposed parallel to the central body portion 102 but in an upward offset position. The central body portion 102 is provided with a downwardly extended fastening tang or prong 105, which is struck from the sub-girt central body portion 102, and which extends downwardly therefrom at right angles in the free state before assembly of the same in the structural panel of FIGS. 11 and 13. A triangular stop flange 106 is also struck from the sub-girt central body portion 102, in a position spaced inwardly from the tang 105, and at right angles thereto, as shown in FIG. 12. A second tang **105*a* and stop flange 106*a* are also formed at the other end of the sub-girt central body portion 102, but they extend upwardly in the opposite direction to the tang 105 and the stop flange 106**.

Integrally formed at one end of the sub-girt central body portion 102 is a longitudinal, outwardly extended and centrally located flange 109, which has integrally formed on the outer end thereof a U-shaped bight member 110. Integrally connected to the U-shaped bight member 110 is an inwardly extended flange 111. It will be seen that the flanges 109 and 111, and the U-shaped bight member 110 form a U-shaped hook or joint member, generally indicated by the numeral 112. It will be seen that the flange 109 is extended outwardly in the same plane as the central body portion 102. Integrally formed at the opposite end of the sub-girt central body portion 102, in a position in axial alignment with the hook shaped joint member 112 is a second hook shaped joint member, generally indicated by the numeral 113. However, the hook shaped joint member 113 is offset upwardly from the plane of the central body portion 102. As best seen in FIG. 12, the hook shaped joint member 113 includes a first flange 114 which is integral with the central body portion 102 and which angles upwardly and outwardly therefrom. Integrally connected to the outer end of the flange 114, is a flange 115 which is offset upwardly and parallel to the central body portion 102. Integrally formed on the outer end of the flange 115 is a U-shaped bight portion 116 which, in turn, is integral with an inwardly extended flange 117 which is parallel to the flange 115, so as to form the hook shaped joint member 113.

The prefabricated panel 84 may be made to any desired width and length, as described hereinbefore for the first and second embodiment. The prefabricated structural panel 84 is assembled, as shown in FIGS. 12 and 13, with one of the panel members, as the panel member 86, being offset laterally about two or three inches relative to the other panel member 85. The sub-girts 89 are disposed at any desired distance apart from each other, as for example, 2 feet, 3 feet, 4 feet, and so forth. As shown in FIGS. 11 and 13, the flange 98 is slid into the hook shaped joint member 113 on one end of the sub-girt member 89, and the joint member 113 is clamped against the flange 98. A similar locking action is also provided at the other end of the sub-girt 89. As shown in FIG. 13, the flange **98*a* on the lower panel 86 is seated in the hook shaped joint member 112, and the joint member 112 is clamped to the flange 98*a*. As shown in FIG. 13, the tang 105*a* is bent or folded inwardly over the leg 95 of the mechanical joint 96 so as to securely lock together the adjacent ends of the panels 85 and 86. The joint member 96 abuts the stop flange 106*a*. A similar locking action is also provided at the other end of the sub-girt 89. As shown in FIG. 13, the tang 105 is folded over the joint leg 95*a* of the U-shaped joint 96*a*. The stop flange 106 abuts the joint member 96*a***.

As shown in FIG. 13 the joint member 96 has operatively mounted therein a suitable vinyl seal 120 or in lieu thereof a suitable caulking 120. The joint member **96*a* has a similar vinyl seal 120*a* or in lieu thereof a suitable caulking. The embodiment of FIGS. 11, 12 and 13 shows the panels 85 and 86 to be provided with a flush outer face, and with each of the panels to have the same profile. When the panels 84 are erected on the job, they are mated together as shown in FIG. 11, with the joint member 113 of one panel being received in the U-shaped joint member 96 of an adjacent panel and in sealing engagement with the seal 120. The joint member 112 on the opposite end of the panel 84 is received in the joint member 96*a* of an adjacen panel member and is in sealing engagement with a seal 120*a*** on the next adjacent panel.

It will be seen from the disclosures of FIGS. 11 and 13, that the sub-girt fastening member 89 of the third embodiment is disposed between the panel members 85 and 86 on an axis which is angular relative to the outer walls of the panel members; that is, it is disposed on a slope relative to the outer plane of the panel faces and the resultant paneled wall which is formed by erecting a plurality of the panels 84 in a side-by-side manner, as shown in FIG. 11. The panel embodiment of FIGS. 11 through 13 offers the same advantages and features as described hereinbefore for the first embodiment of FIGS. 1 through 4.

Figure 14:
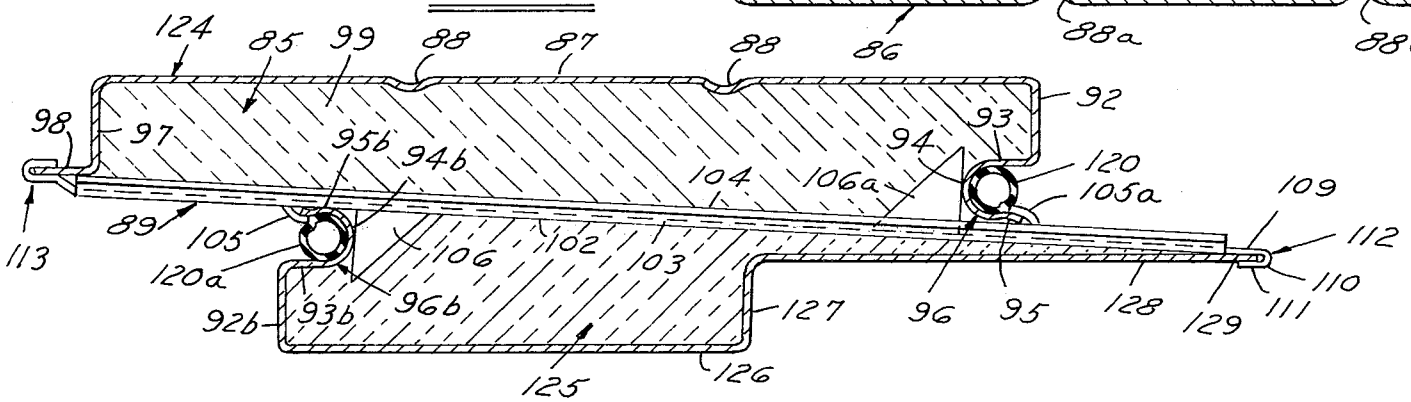
FIG. 14 is a view similar to FIG. 13, and illustrating a modified structural panel made in accordance with the invention, wherein the panel members are each formed with a different profile.

FIG. 14 illustrates a fourth embodiment of the invention wherein the prefabricated structural panel is generally indicated by the numeral 124. The panel 124 is provided with a first panel member, generally indicated by the numeral 85, which is the same as the first panel member of the embodiment of FIGS. 11 through 13. The panel member 85 is marked with the same reference numerals as used in the embodiment of FIGS. 11 through 13. The panel 124 further includes a second panel, generally indicated by the numeral 125, which has an outer wall portion 126 that forms substantially one-half of the panel 125 as illustrated in FIG. 14. The panel portion 125 includes along one side thereof an integral side wall portion **92*b* which extends inwardly at right angles to the plane of the wall portion 126, and which terminates at an integral, substantially U-shaped mechanical joint, generally indicated by the numeral 96*b*. The mechanical joint 96*b* includes a stright leg portion 93*b* which has one end integral with the inner end of the side wall portion 92*b*, and the other end integral wall one end of a U-shaped bight portion 94*b*. The mechanical joint member 96*b* further includes a second integral arcuate leg portion 95*b*, and the outer end is extended to a point substantially parallel with the plane of the side wall portion 92*b*. The arcuate leg portion 95*b* has an arcuate central portion which is shaped convex inwardly toward the opposite leg 93*b***.

As shown in FIGS. 14, the panel 125 further includes an integral central wall portion 127 which extends inwardly at the right angles to the plane of the wall portion 126 and which terminates at its inner end in an integral second wall portion 128. The wall portions 126 and 128 are flat and planar, with the wall portion 128 being disposed inwardly so as to provide the panel 125 with a fluted outward appearance.

The outer wall portion 128 is angled inwardly toward the sub-girt member 89, and the outer end 129 is clamped in a hook-shaped joint member 112 on the adjacent end of the sub-girt 89. The panel 124 is provided with the same type sealing means as shown in the panel embodiment of FIGS. 11 through 13. The panel 124 may be erected on the site, in the same manner as the previously described embodiments, and it offers the same advantages and features of the other described embodiments of the invention.

In forming a wall for a building with the panels 9, 50, 84 and 124 of the present invention, the panels would be disposed endwise in alignment with each other and secured by conventional attachment means to the building frame structure. The structural panels of the present invention are adapted to be inter-engaged with each other in a lateral direction. For example, the joint means 23 of a first panel of the first embodiment shown in FIG. 4 would be operatively received in a sealing engagement by the U-shaped joint 15 in an adjacent second panel 9. The joint means 23*a* of the second panel would be similarly received in the joint means 15*a* of the first panel 9. It will be seen that the second embodiment panel 50 is also adapted to be mounted in plural units in a lateral direction in the same described manner, that is, a joint means 61 of a first panel would be received by a joint means 60 of an adjacent second panel while the joint means 60*a* of the second panel would receive the joint means 61*a* of the adjacent first panel. The embodiments of FIGS. 11 and 14 function in a like manner.

While it will be apparent that the preferred embodiments of the invention herein disclosed are well calculated to fulfill the objects above stated, it will be appreciated that the invention is susceptible to modification, variation and change.

What is claimed is:

1. In a structural panel, the combination comprising:
(a) a pair of spaced apart panel members;
(b) each of said panel members having a main body portion forming an outer wall, and integral first and second side end portions forming side walls transverse to the outer face and having a free end;
(c) a joint means formed on the free end of each side end portions;
(d) said panel members facing each other and being disposed in a lateral offset relationship; and,
(e) at least one elongated sub-girt fastening member being disposed between said panel members on an acute angular axis relative to the outer walls of the panel members, and being mechanically attached at each end thereof to said joint means on each of the adjacent ends of the panel members for securing the panel members together.

2. A structural panel as defined in claim 1, wherein:
(a) said panel members are mechanically attached together by a plurality of said sub-girt fastening members.

3. A structural panel as defined in claim 2, wherein:
(a) each of said sub-girt fastening members is provided with means for locating and retaining said panel members in their lateral offset relationship.

4. A structural panel as defined in claim 3, wherein:
(a) the joint means on the first side end portion on each of the panel members comprises a longitudinally extended U-shaped joint member extending inwardly from the free end of the first side end portion.

5. In a structural panel, the combination comprising:
(a) a pair of spaced apart panel members;
(b) each of said panel members having a main body portion forming an outer wall, and integral first and second side end portions forming side walls transverse to the outer face and having a free end;
(c) a joint means formed on the free end of each side end portions;
(d) said panel members facing each other and being disposed in a lateral offset relationship;
(e) at least one sub-girt fastening member being disposed between said panel members on an angular axis relative to the outer wall of the panel members, and being mechanically attached to said joint means for securing the panel members together;
(f) said panel members being mechanically attached together by a plurality of said sub-girt fastening members;
(g) each of said sub-girt fastening members being provided with means for locating and retaining said panel members in their lateral offset relationship;
(h) the joint means on the first side end portion on each of the panel members comprising a longitudinally extended U-shaped joint member extending inwardly from the free end of the first side end portion; and,
(i) each of the sub-girt fastening members being provided with at least one mechanical locking member for locking engagement with the U-shaped joint members located on the first side end portions of the panel members.

6. A structural panel as defined in claim 5, wherein:
(a) each of said U-shaped joint members has a longitudinally extended tubular seal member mounted therein.

7. A structural panel as defined in claim 5, wherein:
(a) said locating and retaining means on each of said sub-girt fastening members comprises a pair of flange members engageable with an adjacent joint means on said panel members.

8. A structural panel as defined in claim 5, wherein:
(a) the joint means on the second side end portion on each of the panel members comprises a longitudinally extended U-shaped joint member facing inwardly of the panel; and
(b) each of the sub-girt fastening members is provided with two free ends that are slidably received in said U-shaped joint members on the second side end portions and are crimped thereto.

9. A structural panel as defined in claim 8, wherein:
(a) an insulation means is operatively mounted between the sub-girt fastening members free ends and the U-shaped joint members on the second side end portions.

10. A structural panel as defined in claim 5, wherein:
(a) the joint means on the second side end portion on each of the panel members comprises a longitudinally extended, shaped flange means;
(b) one of said longitudinally extended shaped flange means on one panel member is provided with a plurality of longitudinally spaced apart slots; and,
(c) each of the sub-girt fastening members is provided on one end thereof with a tongue which is slidably mounted in one of the slots in said one shaped flange means, and each sub-girt fastening member is provided on the other end thereof with a hook joint member for slidably receiving the shaped flange means on the other panel member.

11. A structural panel as defined in claim 5, wherein:
(a) the joint means on the second side end portion on each of the panel members comprises a longitudinally extended flange means; and,
(b) each of the sub-girt fastening members is provided on each end thereof with a hook joint member for slidably receiving the flange means on one of the second side end portions of one of the panel members.

12. A structural panel as defined in claim 5, wherein:
(a) each of said panel members is provided with insulation means.

* * * * *

UNITED STATES PATENT OFFICE

CERTIFICATE OF CORRECTION

Patent No. 4,122,641 Dated October 31, 1978

Inventor(s) John A. Bard and Francis J. Morrison

It is certified that error appears in the above-identified patent and that said Letters Patent are hereby corrected as shown below:

Column 9, line 68, "adjacen" should be --adjacent.
Column 10, line 32, "stright' should be --straight--.
Column 10, line 35, "wall" should be --with--
Column 10, line 42 "FIGS" should be --FIG--.

Signed and Sealed this

*Sixth* Day of *February 1979*

[SEAL]

*Attest:*

RUTH C. MASON
*Attesting Officer*

DONALD W. BANNER
*Commissioner of Patents and Trademarks*